US005538069A

United States Patent [19]

Freeman

[11] Patent Number: 5,538,069

[45] Date of Patent: Jul. 23, 1996

[54] DIE CAST VACUUM VALVE

[76] Inventor: Lewis G. Freeman, 1509 Pontiac Dr., Kokomo, Ind. 46902

[21] Appl. No.: 312,309

[22] Filed: Sep. 26, 1994

[51] Int. Cl.[6] ..... B22D 17/14; B22D 17/20

[52] U.S. Cl. ..... 164/253; 164/305

[58] Field of Search ..... 164/254, 253, 164/305, 410

[56] References Cited

U.S. PATENT DOCUMENTS

| | | | |
|---|---|---|---|
| 3,070,857 | 1/1963 | Venus . | |
| 3,590,114 | 6/1971 | Uhlig | 264/328 |
| 4,027,726 | 6/1977 | Hodler | 164/305 |
| 4,099,904 | 7/1978 | Dawson | 425/563 |
| 4,463,793 | 8/1984 | Thurner | 164/155 |
| 4,577,670 | 3/1986 | Moore | 164/155 |
| 4,680,003 | 7/1987 | Schulte et al. | 425/206 |
| 4,938,274 | 7/1990 | Iwamoto et al. | 164/305 X |
| 4,995,445 | 2/1991 | Shigyo | 164/305 |
| 5,101,882 | 4/1992 | Freeman | 164/457 |

FOREIGN PATENT DOCUMENTS

| | | | |
|---|---|---|---|
| 57-81949 | 5/1982 | Japan . | |
| 58-97478 | 6/1983 | Japan . | |
| 60-11590 | 3/1985 | Japan | 164/305 |
| 62-151258 | 7/1987 | Japan | 164/305 |
| 63-242458 | 10/1988 | Japan | 164/253 |
| 346361 | 6/1960 | Switzerland . | |

*Primary Examiner*—J. Reed Batten, Jr.
*Attorney, Agent, or Firm*—Christopher A. Taravella

[57] ABSTRACT

A valve for a vacuum die casting machine has a cover die block and an ejector die block. A slotted member and an abutting slotless member abutting the slotted member are movable between an open, fluid-passing position and a closed, fluid-blocking position. A controller directs movement of the valve between the open and closed positions. The valve is moved to its open position as the air within the cavity and associated lines is being evacuated and is moved to its closed position as the shot is injected into the die cavity. The slotted and slotless members may either be rotatable drums or elongated bars. The slotted drum includes a slotted end and an actuation end. Similarly, the slotted elongated bar includes a slotted end and an actuation end. Alignment of the slot of either the rotatable slotted drum or the movable slotted bar with the vacuum passage allows the passage of fluid.

26 Claims, 10 Drawing Sheets

DIE CAST VACUUM VALVE

BACKGROUND AND SUMMARY OF THE INVENTION

The present invention relates to valves for vacuum die casting machines. More particularly, the present invention relates to a valve having a slotted member that is movable between a fluid-passing position and a fluid-blocking position.

A cast part produced from a die under a vacuum has less porosity and a superior hardware finish compared with similar parts cast under ambient air pressure conditions. Die casting machines for feeding and casting under vacuum incorporate a hermetically sealed part cavity defined by a pair of dies fluidly associated with a vacuum pump. In such machines a vacuum is first created within the cavity. Molten metal enters the cavity, being moved partially because of the vacuum and partially because of the movement of a shot plunger driven by a power cylinder.

Between the mold cavity and the vacuum pump is a vacuum valve that is controlled to selectively interrupt fluid communication between the cavity and the pump at a preselected interval during the casting process. The vacuum valve can only remain open to allow the desired vacuum to be created within the cavity but must be closed prior to the passage of molten metal.

Several types of systems and valves exist which are directed to the evacuation of fluid from a die cavity. The systems and valves are illustrated by the following U.S. patents: F. Hodler, U.S. Pat. Nos. 2,785,448, Mar. 19, 1957; F. Hodler, U.S. Pat. No. 2,867,869, Jan. 13, 1959; D. M. Morgenstern, U.S. Pat. No. 2,904,861, Sep. 22, 1959; W. Venus, U.S. Pat. No. 3,070,857, Jan. 1, 1963; F. Hodler, U.S. Pat. No. 3,885,618, May 27, 1975; Hodler, U.S. Pat. No. 4,027,726, Jun. 7, 1977; Ernst et al., U.S. Pat. No. 4,729,422, Mar. 8, 1988; Runhlandt et al., U.S. Pat. No. 4,779,666, Oct. 25, 1988; Uchida et al., U.S. Pat. No. 4,782,886, Nov. 8, 1988; Voss et al., U.S. Pat. No. 4,809,767, Mar. 7, 1989; Voss et al., U.S. Pat. No. 4,825,933, May 2, 1989; Klenk, U.S. Pat. No. 4,832,109, May 23, 1989.

While the above patents appear to perform satisfactorily for their intended purpose, designers are always striving to improve the art.

SUMMARY OF THE INVENTION

It is an object of the present invention to provide an improved valve for use in a vacuum die casting machine that incorporates a slotted member that is movable between an open, fluid-passing position and a closed, fluid-blocking position.

It is a further object of the present invention to provide such a valve that is easily moved between the open, fluid-passing position and the closed, fluid-blocking position.

Still a further object of the present invention is to provide a valve that is practical to operate and is relatively easy to maintain.

The above and other objects of the present invention are achieved through the provision of the present valve having a movable slotted member for controlling the flow of fluid and a movable slotless member that abuts the slotted member and moves as the slotted member moves. The valve of the present invention is adapted to be either coupled with a casting die pair or integrated with the die blocks in a vacuum casting machine. A controller directs movement of the valve between the open and closed positions. The valve is moved to its open position as the air within the cavity and associated lines is being evacuated and is moved to its closed position as the shot is injected into the die cavity.

The slotted member may either be a rotatable slotted drum or an elongated slotted bar. The slotted drum includes a slotted end and an opposite actuation end. Rotation of the slotted drum is effected preferably by a rack and pinion system in which the gears of a rack are meshed with the gears of the actuation end of the slotted drum. Axial movement of the rack is translated into rotational movement of the slotted member. Alignment of the slot with the vacuum passage allows the passage of fluid. A slotless drum is provided opposite the slotted drum and abuts the slotted end of the slotted drum. Rotation of the slotless drum is also effected preferably by a rack and pinion system.

The slotted elongated bar also includes a slotted end and an actuation end. Axial movement of the slotted bar may be effected by a rack and pinion system in which the actuation end of the bar defines a geared rack and a meshed pinion drives the rack. Alternatively, the actuation end of the bar is associated with a piston operated either hydraulically or pneumatically. A slotless bar is provided opposite the slotted bar and abuts the slotted end of the slotted bar. Axial movement of the slotless bar is also effected by either a rack and pinion system or by a hydraulically- or pneumatically-operated piston. Like the rotatable drum, alignment of the slot with the vacuum passage allows passage of fluid.

BRIEF DESCRIPTION OF THE DRAWINGS

The various advantages of the present invention will become apparent to one skilled in the art by reading the following specification and subjoined claims and by referencing the following drawings in which like reference characters refer to like parts throughout the views in the accompanying drawings and in which:

DETAILED DESCRIPTION OF THE PREFERRED EMBODIMENT

In general, the present invention discloses a novel valve for use in a vacuum die casting system. More particularly, the present invention is a modified version of the vacuum valve disclosed in the Assignee's U. S. Pat. No. 5,101,882, issued Apr. 7, 1992, to L. G. Freeman for DIE CAST VACUUM VALVE SYSTEM, incorporated herein by reference. That patent discloses a die casting vacuum valve having a reciprocating piston that selectively interrupts the flow of fluid from the die casting cavity to the vacuum pump. A controller acts to control the reciprocation of the piston.

With this reference as a background, the present invention particularly relates to a vacuum valve for use in a vacuum die casting apparatus incorporating a slotted member that is movable between an open, fluid-passing position and a closed, fluid-blocking position. However, it will be appreciated that the teachings of the present invention can be readily incorporated into virtually any vacuum system. As used herein, the term "fluid" is used to encompass the flow through the vacuum valve of both gases and liquids in the manner more specifically set forth hereafter. Also as occasionally used herein, terms such as "above", "underside", and "upper" are used for explanatory purposes only with reference to the accompanying drawings, and are not intended to be limiting.

Figure 1:
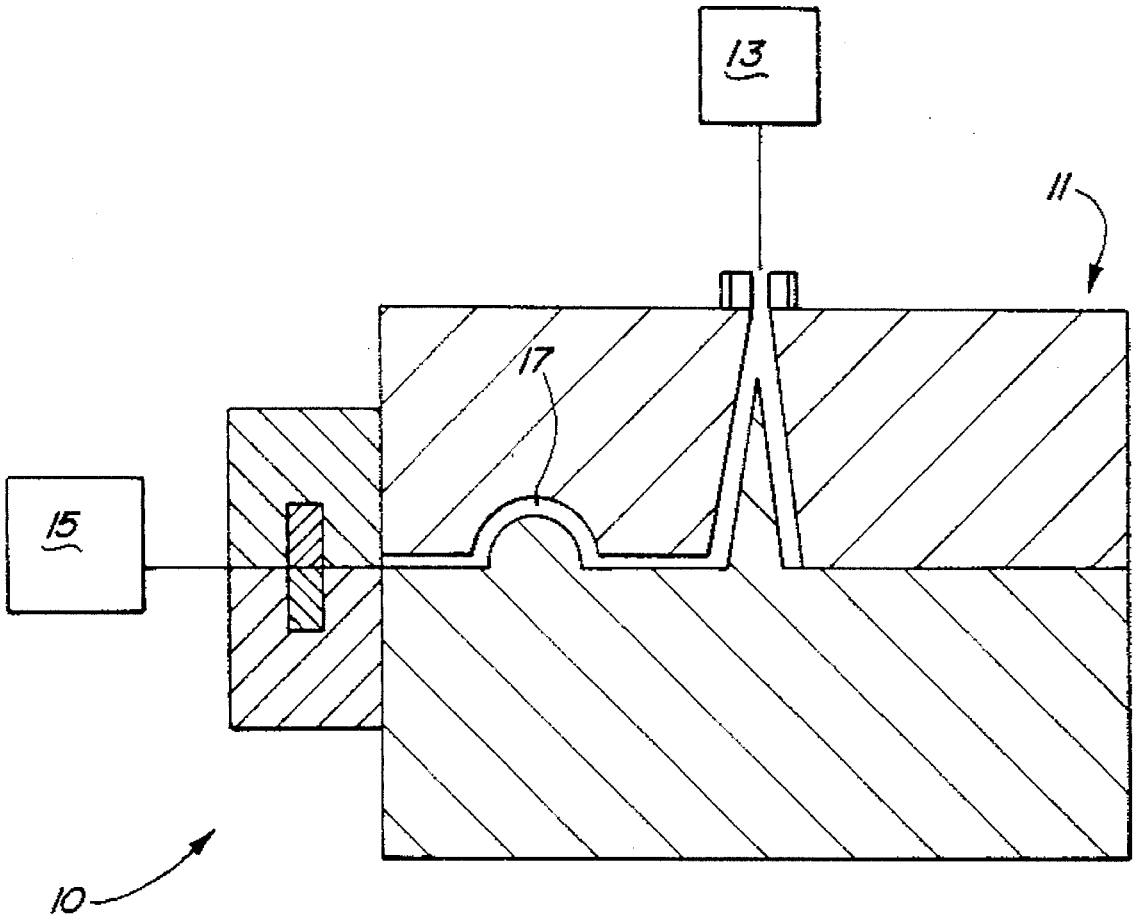
FIG. 1 is an environmental view of a vacuum die casting system incorporating the vacuum valve of the present invention.

FIG. 1 illustrates an environmental view of a vacuum die casting system incorporating the vacuum valve of the present invention. The vacuum valve, designated as 10, is preferably integrally associated with a die casting apparatus, generally indicated as 11. Alternatively, the valve 10 of the present invention may well be a separate modular assembly attached to a die casting apparatus in a fashion similar to that set forth in the above-mentioned U. S. Pat. No. 5,101,882.

A molten metal source 13 is provided in association with the casting apparatus 11 to provide the molten material for casting. A vacuum pump 15 is provided to draw fluid from the apparatus 11 through the valve 10 so as to create a vacuum within a mold cavity 17.

The apparatus 11 includes a cover die 12 and an ejector die 14. The mold cavity 17 is generally in both of the dies and is separated by a parting line or plane 16 which is formed between the cover die 12 and the ejector die 14. Each of the cover die and ejector die halves 12 and 14 respectively should be produced from slabs or plates with each piece being Blanchard ground flat and parallel thereby reducing the risk of flashing at the parting line 16.

With reference more broadly to FIGS. 1 through 5, the ejector die 14 includes an ejector top plate 18 and a first half of a die cast vent block 20. The second half of the die cast vent block 20 is defined in the cover die 12. The vent block 20 is constructed so as to define a serpentine path between the first and second halves for the flow of molten material and restricts, stops and prevents flow of the material in the case of an electrical or mechanical malfunction. The vent block 20 is the subject of my copending United States patent application for DIE CAST VENT BLOCK, U.S. patent application Ser. No. 08/312,308 filed Sep. 26, 1994, the specification and drawings of which are expressly incorporated by reference.

According to the present embodiment, the ejector top plate 18 is continuous with the ejector die 14. The ejector top plate 18 includes a passageway or notch 22 enabling an overflow runner to be formed therein when the cavity is filled with molten material. The ejector top plate 18 includes a cooling passageway 24.

A bore 26 is defined in the ejector top plate 18 to provide a passage for a rotatable slotted shut-off drum 28. A bushing 30 is positioned in the bore 26 within which the drum 28 is rotatably mounted.

The ejector top plate 18 is secured to the ejector die 14 by a plurality of fasteners 34. The upper portion of the ejector die 14 includes a bore 38 which houses the rotatable slotted shut-off drum 28.

Figure 2:
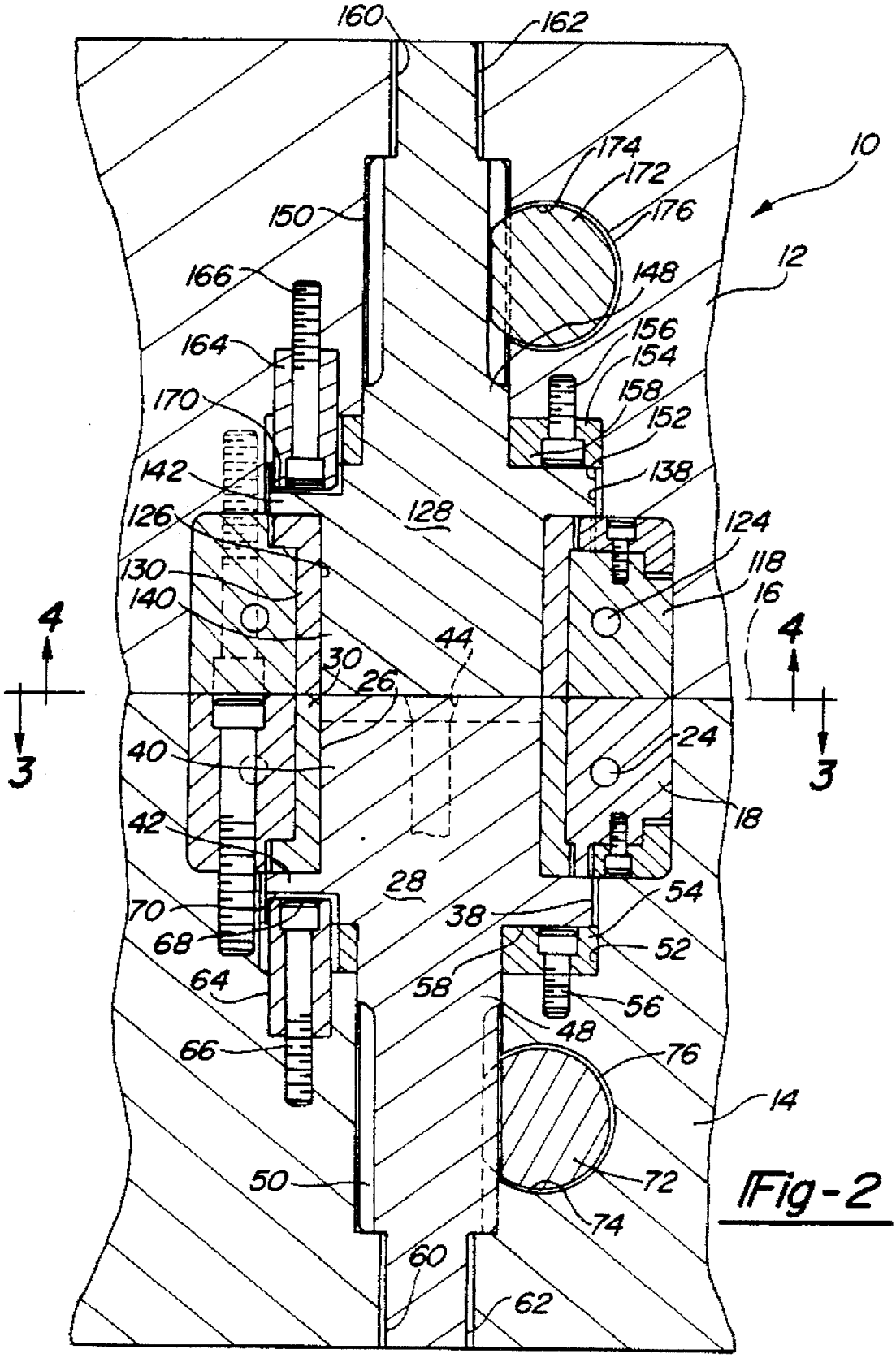
FIG. 2 is an elevational and sectional view of a vacuum valve in accordance with the present invention.
Figure 3:
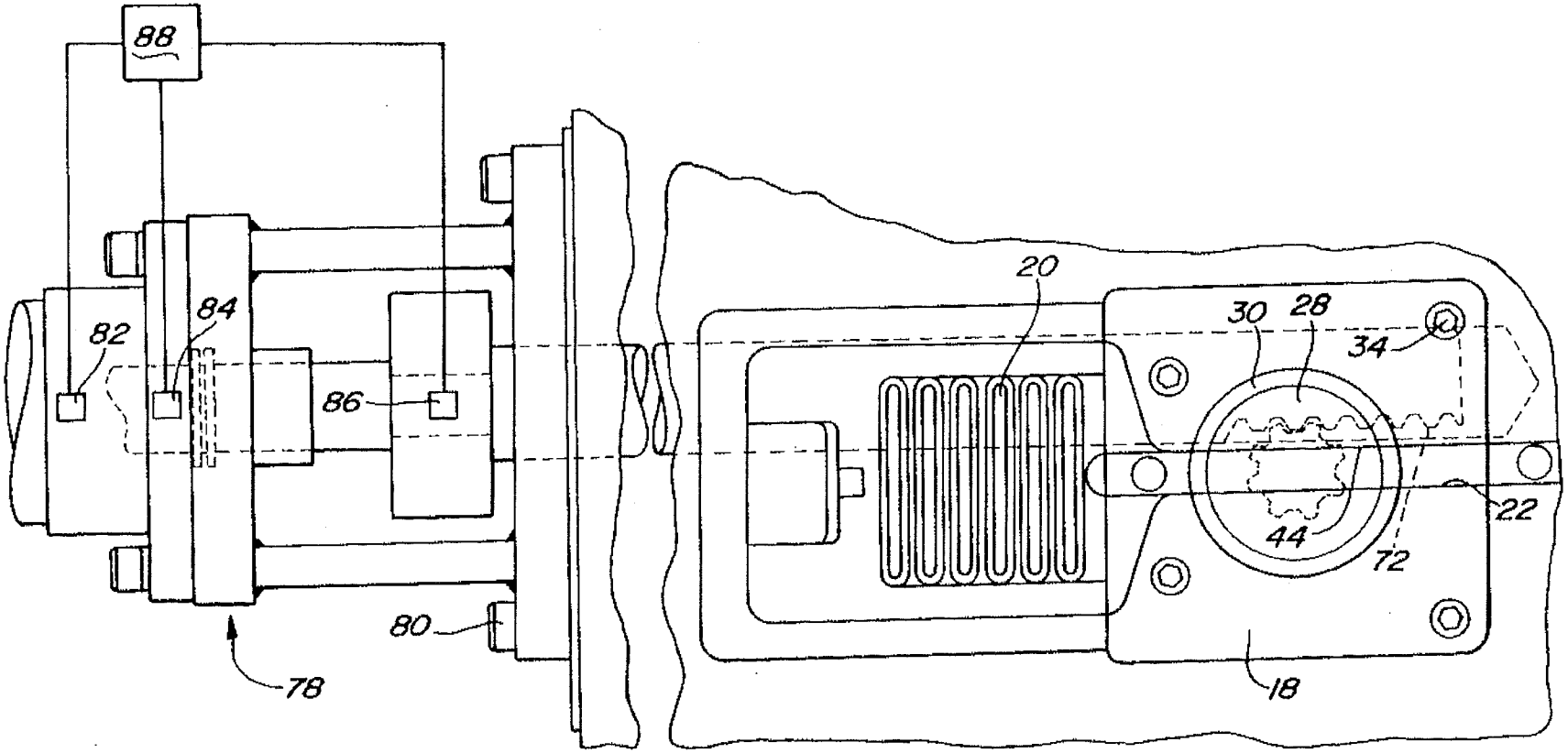
FIG. 3 is a plan view of the valve of FIG. 2 taken along a plane defined by line 3—3 thereof.
Figure 4:
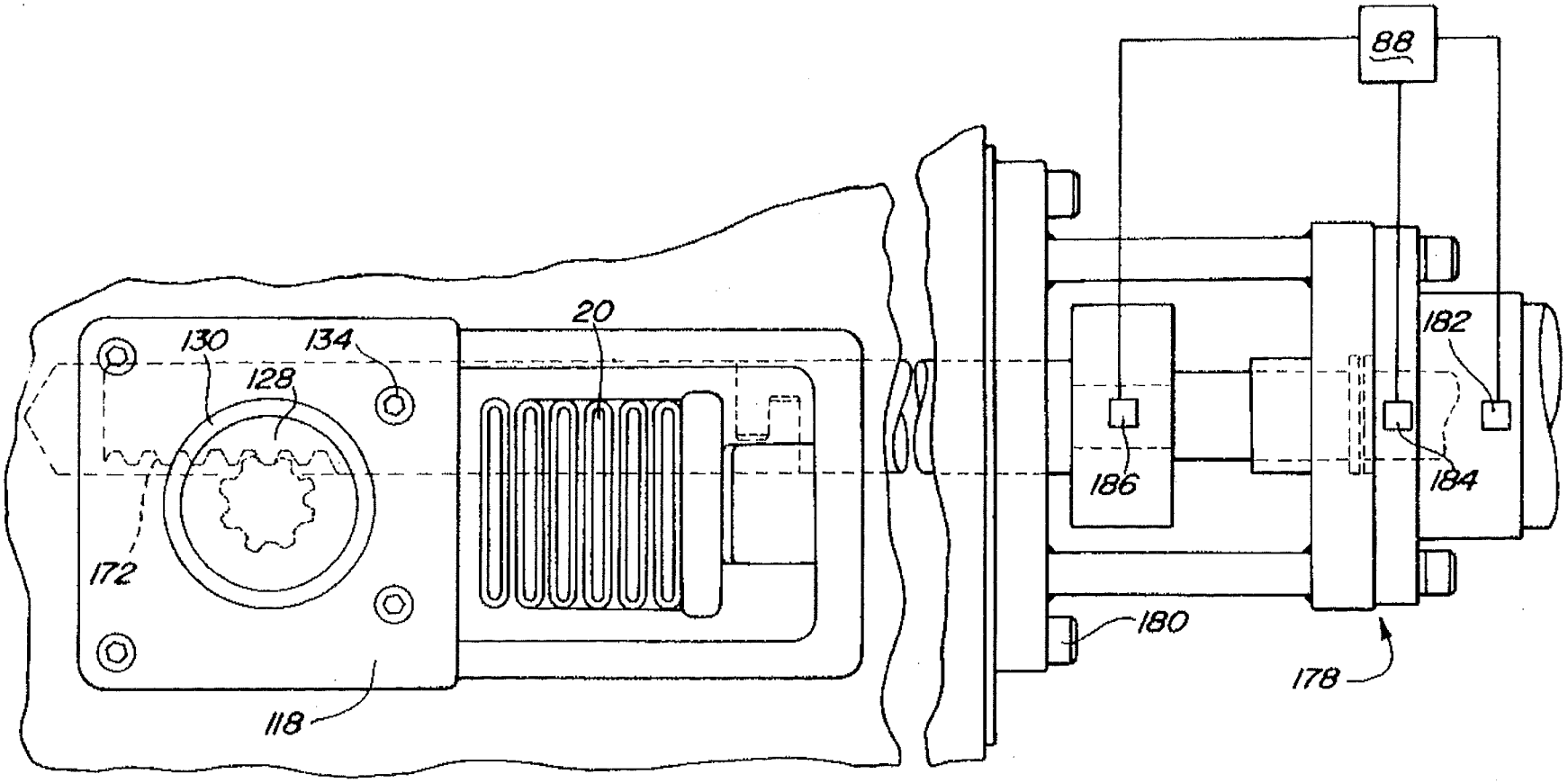
FIG. 4 illustrates a plan view of FIG. 2 taken along a plane defined by the line 4—4 thereof.

The rotatable slotted shut-off drum 28 generally includes an elongated cylindrical neck 40 and a body 42. The neck 40 and body 42 are generally of a unitary one-piece construction being circular in cross-section. The neck 40 is of a diameter less than the body 42 and includes a slot 44 defined in its free extending end. The position of the slot 44 relative the passageway 22 determines whether or not fluid passes from the cavity 17 to the vacuum pump 15. As illustrated in FIGS. 2 and 3, the rotatable shut-off drum 28 is in its open position in which the slot 44 is positioned in axial alignment with passageway 22, thereby allowing the passage of fluid.

The rotatable slotted shut-off drum 28 further includes a lower actuation end 48 that is preferably of a diameter less than that of both its adjacent body 42 and the neck 40. On the actuation end 48 are a number of parallel, axially defined grooves that comprise an actuation gear 50.

A counterbore 52 is defined in the upper part of the ejector die 14, and a drum support bushing 54 is fitted within the counterbore 52. The bushing 54 is fixed in the counterbore 52 by a fastener 56. A radial shoulder 58 is defined along the underside of the body 42. The shoulder 58 rotatably rides upon the support bushing 54 provided within the counterbore 52. A narrow bore 60 is defined in the ejector die 14 to accommodate the terminal portion of the lower actuation end 48 of the slotted drum 28. A sleeve bushing 62 is positioned between the actuation end 48 and the ejector die 14. The bores 26, 38, 52, and 60 are axially aligned.

The rotatable slotted shut-off drum 28 is selectively rotatable from an open position to allow fluid flow from the cavity (not shown) to the vacuum pump (also not shown) to a closed position blocking the flow. Accordingly, the slotted drum 28 needs only to be rotated approximately 90 degrees from one position to the other to effect allowance or restriction of the flow of the fluid. A stop block 64 is provided within the counterbore 52 to limit rotational movement of the drum 28. The block 64, fixed within the bore by a fastener 66, includes a drum engaging end 68 for engagement with an arcuate slot 70 defined in the underside of the body 42 of the drum 28. The configuration of the arcuate slot 70 restricts rotation of the slotted drum 28 within a preselected range of motion.

The gear 50 of the lower actuation end 48 is engaged with a axially reciprocating rack 72 that is provided within an axial bore 74. A sleeve bushing 76 provided within the bore 74 insulates the rack 72 from excessive wear. A driving assembly, generally illustrated as 78, is secured to the ejector die 14 by fasteners such as bolts 80. The driving assembly 78 is generally of the hydraulic type, although pneumatic cylinders may be used. The assembly 78 is coupled with one or more limit switches 82, 84, and 86 which, in turn, are coupled with a controller 88. Other sensors capable of sensing position changes, such as a linear transducer, may be utilized in place of the limit switches.

The cover die 12 is fitted over the ejector die 14 and, but for the vacuum passageways, is essentially a mirror image of the ejector die 14 and its components.

The cover die 12 includes a cover bottom plate 118 and the second half of the die cast vent block 20. As noted above, the second half of the die cast vent block 20 substantially mates with the first half of the die cast vent block 20 defined in the ejector die 14 to inhibit the flow of molten material in the event of a malfunction.

According to the present embodiment, the cover bottom plate 118 is continuous with the cover die 12. The cover bottom plate 118 includes a cooling passageway 124.

A bore 126 is defined in the cover bottom plate 118 to provide a passage for a rotatable slotless drum 128. The lower surface of the slotless drum 128 continuously abuts the upper slotted surface of the slotted drum 28. A bushing 130 is positioned in the bore 126 within which the slotless drum 128 is rotatably mounted.

The cover bottom plate 118 is secured to the cover die 12 by a plurality of fasteners 134. The lower portion of the cover die 12 includes a bore 138 which houses the rotatable slotless drum 128.

The rotatable slotless drum 128 generally includes an elongated cylindrical neck 140 and a body 142. The neck 140 and the body 142 are generally of a unitary one-piece construction being circular in cross-section. The neck 140 is of a diameter less than the body 142.

The rotatable slotless drum 128 further includes an upper actuation end 148 that is preferably of a diameter less than that of both its adjacent body 142 and the neck 140. On the actuation end 148 are a number of parallel, axially defined grooves that comprise an actuation gear 150.

A counterbore 152 is defined in the lower part of the cover die 12, and a drum support bushing 154 is fitted within the counterbore 152. The bushing 154 is fixed in the counterbore 152 by a fastener 156. A radial shoulder 158 is defined along the underside of the body 142. The shoulder 158 rotatably rides upon the support bushing 154 provided within the counterbore 152. A narrow bore 160 is defined in the cover die 12 to accommodate the terminal portion of the upper actuation end 148 of the slotless drum 128. A sleeve bushing 162 is positioned between the actuation end 148 and the cover die 12. The bores 126, 138, 152, and 160 are axially aligned.

The rotatable slotless drum 128 is selectively rotatable in concert with the rotatable slotted shut-off drum 28 from the latter's open position to allow fluid flow from the cavity 17 to the vacuum pump 15 to the latter's closed position blocking the flow. Accordingly, like the slotted shut-off drum 28, the slotless drum 128 needs only to be rotated approximately 90 degrees from one position to the other. A stop block 164 is provided within the counterbore 152 to limit rotational movement of the slotless drum 128. The block 164, fixed within the bore by a fastener 166, includes a drum engaging end 168 for engagement with an arcuate slot 170 defined in the underside of the body 142 of the slotless drum 128. The configuration of the arcuate slot 170 restricts rotation of the slotless drum 128 within a preselected range of motion.

The gear 150 of the upper actuation end 148 is engaged with an axially reciprocating rack 172 that is provided within an axial bore 174. A sleeve bushing 176 provided within the bore 174 insulates the rack 172 from excessive wear. A driving assembly, generally illustrated as 178, is secured to the cover die 12 by fasteners such as bolts 180. Like the driving assembly 78, the driving assembly 178 is generally of the hydraulic type, although pneumatic cylinders may be used. The assembly 178 is also coupled with one or more limit switches 182, 184, and 186 which, in turn, are coupled with the controller 88. Other sensors capable of sensing position changes, such as a linear transducer, may be utilized in place of the limit switches. The controller 88, along with limit switches 82, 84, 86, and 182, 184, and 186, simultaneously controls the movement of both the rotatable slotted drum 28 and the rotatable slotless drum 128, by way of the assemblies 78 and 178 respectively, in response to the injection of molten material into the die cavity.

A brief explanation of the vacuum casting process is as follows. The die cavity is filled by molten material entering the cavity 17 from a shot sleeve. A hydraulic shot cylinder is provide to push the molten material from the shot sleeve into the cavity 17. The shot bar, coupled with the shot cylinder, covers the port hole in the shot sleeve, thus enabling molten material to be injected into the shot sleeve. The molten material to be injected into the cavity is trapped within the shot sleeve. As this occurs, a signal is sent from the controller 88 to the assemblies 78, 178 to drive both the rotatable slotted shut-off drum 28 and the rotatable slotless drum 128 from their open positions toward their closed positions. As the drums 28, 128 are rotated toward these positions, one of the limit switches on each of the driving assemblies 78, 178 is tripped transmitting a signal back to the controller 88 that the drums 28, 128 are moving toward their closed positions.

In response to this signal, the controller 88 transmits a signal to the vacuum casting apparatus to enter into a fast shot mode and to inject the molten material into the cavity to fill the same. As this occurs, the driving assemblies 78, 178 continue to drive the drums 28, 128 very quickly to their closed positions. The shut-off drum 28 closes off the passageway 22 to stop the flow of molten material thereby preventing overflow while still insuring full gas evacuation of the die cavity, via the passageway 22, filling the die cavity with molten metal. As noted, the rotatable slotless drum 128 moves with the slotted drum 28 and prevents wear that would otherwise occur by the drum 28 rotating against a fixed surface.

As the rotatable drums 28, 128 are rotated to their closed positions sealing off the vacuum passage, another limit switch of each of the assemblies 78, 178 is activated transmitting a signal to the controller 88 indicating that the drums 28, 128 have reached their limit.

After receiving this signal a pair of instructions are issued. The first instruction involves the halting and resetting of the casting machine for further operation. In this situation, the controller 88 transmits a signal to the vacuum casting apparatus instructing that the cavity 17 is full and that further injection of the material should be halted. The controller 88 transmits a signal to the driving assemblies 78, 178 to return the drums 28, 128 to their open positions. Once this occurs, one of the limit switches on each of the assemblies 78, 178 is triggered transmitting a signal to the controller 88 that the driving assemblies 78, 178 have reached their starting positions.

The second instruction involves the separation of the die halves so that the cast article can be retrieved. To this end, the controller 88 transmits a signal to the vacuum casting apparatus which indicates that the cavity 17 is full and to stop further injection of the material and to deactivate the assemblies 78, 178. At this time, the dies would be separated and the casting formed in the cavity 17 would be removed.

Moving to FIGS. 5 through 10, additional embodiments of the present invention are illustrated. The vacuum valve of these figures illustrates a variation of the rotatable slotted shut-off mechanism from the cylindrical drum of FIGS. 2 through 4.

Figure 5:
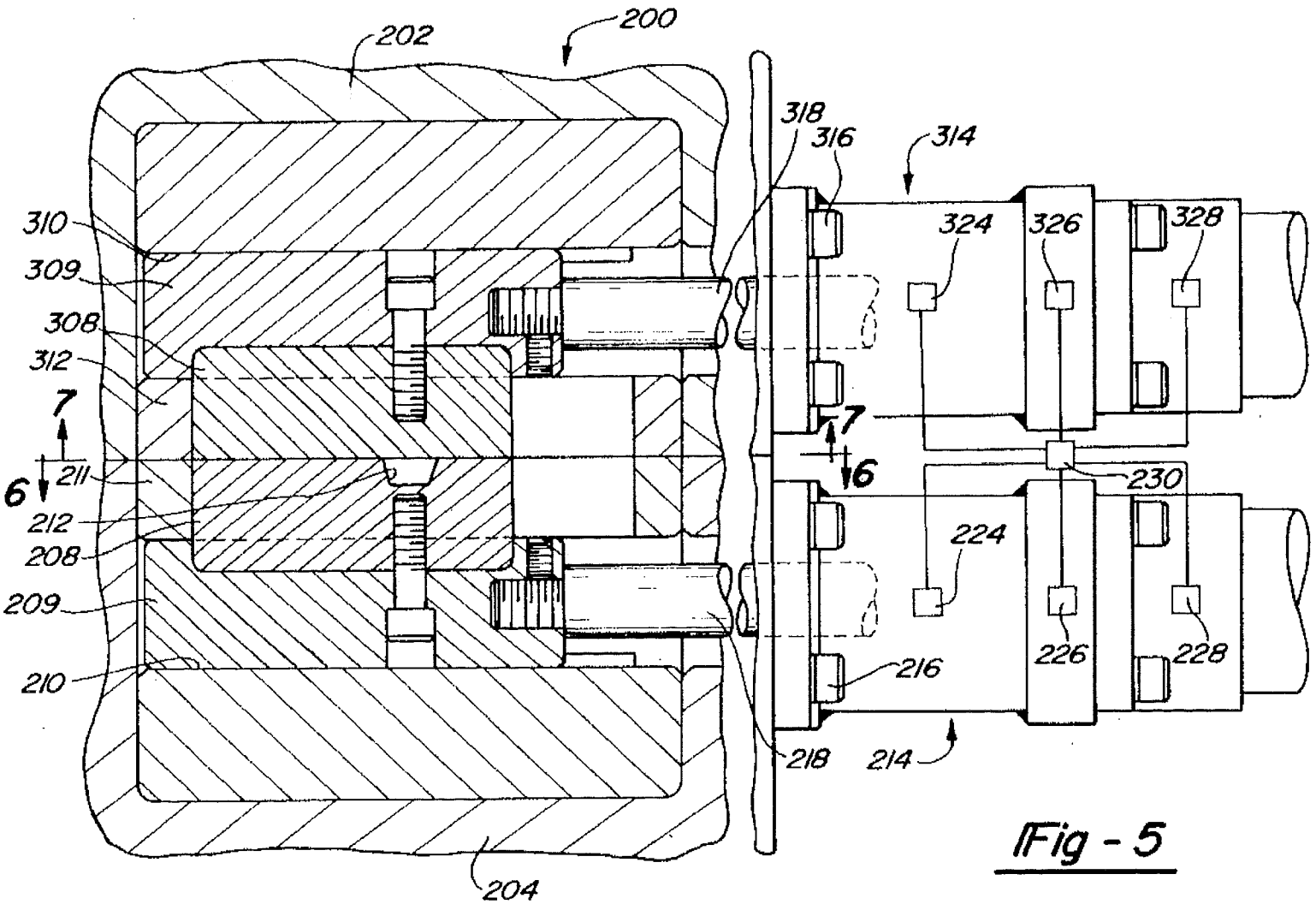
FIG. 5 is an elevational and sectional view of an alternate embodiment of a vacuum valve in accordance with the present invention.
Figure 6:
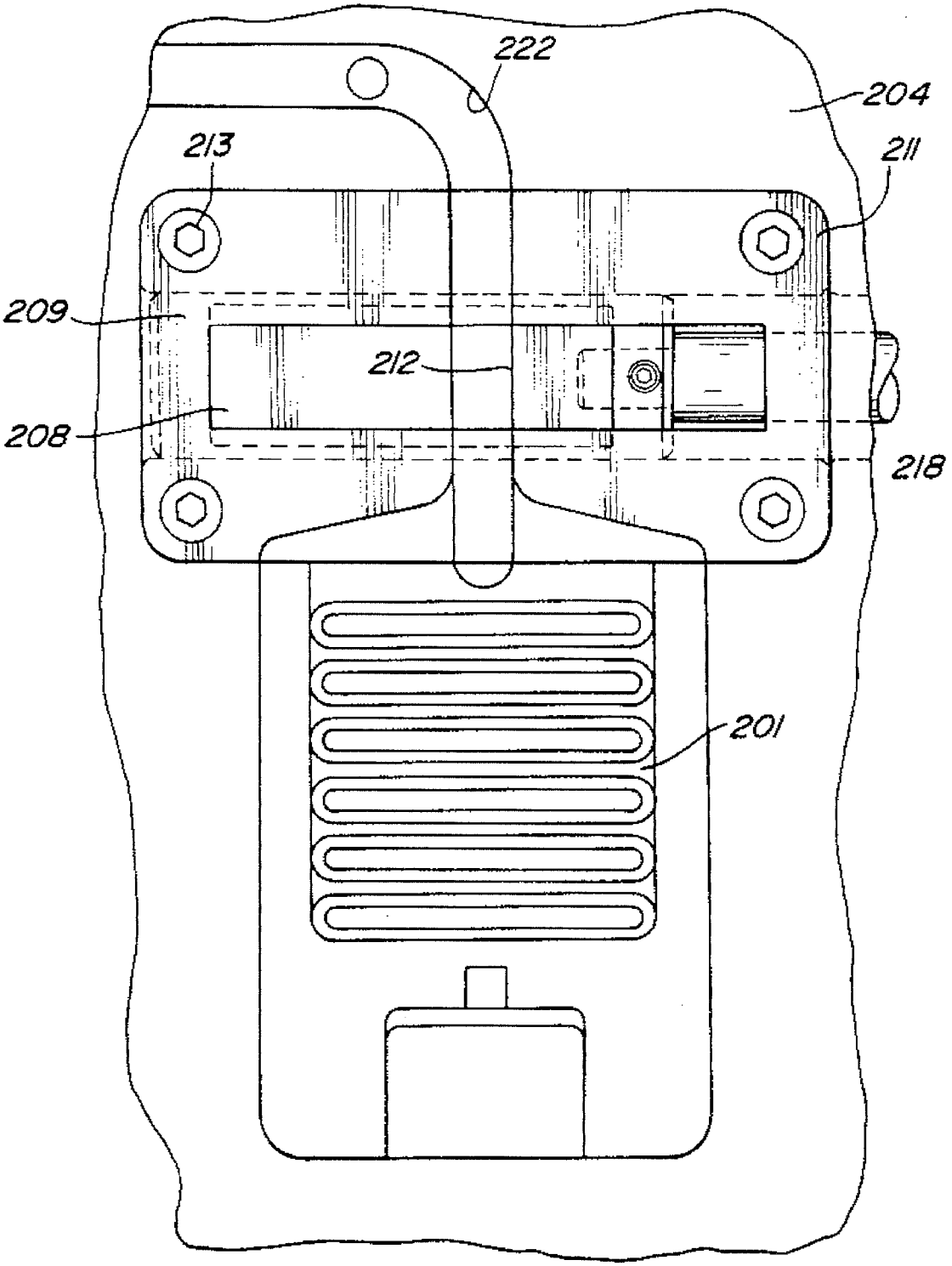
FIG. 6 is a plan view of the valve of FIG. 5 taken along a plane defined by the line 6—6 thereof.
Figure 7:
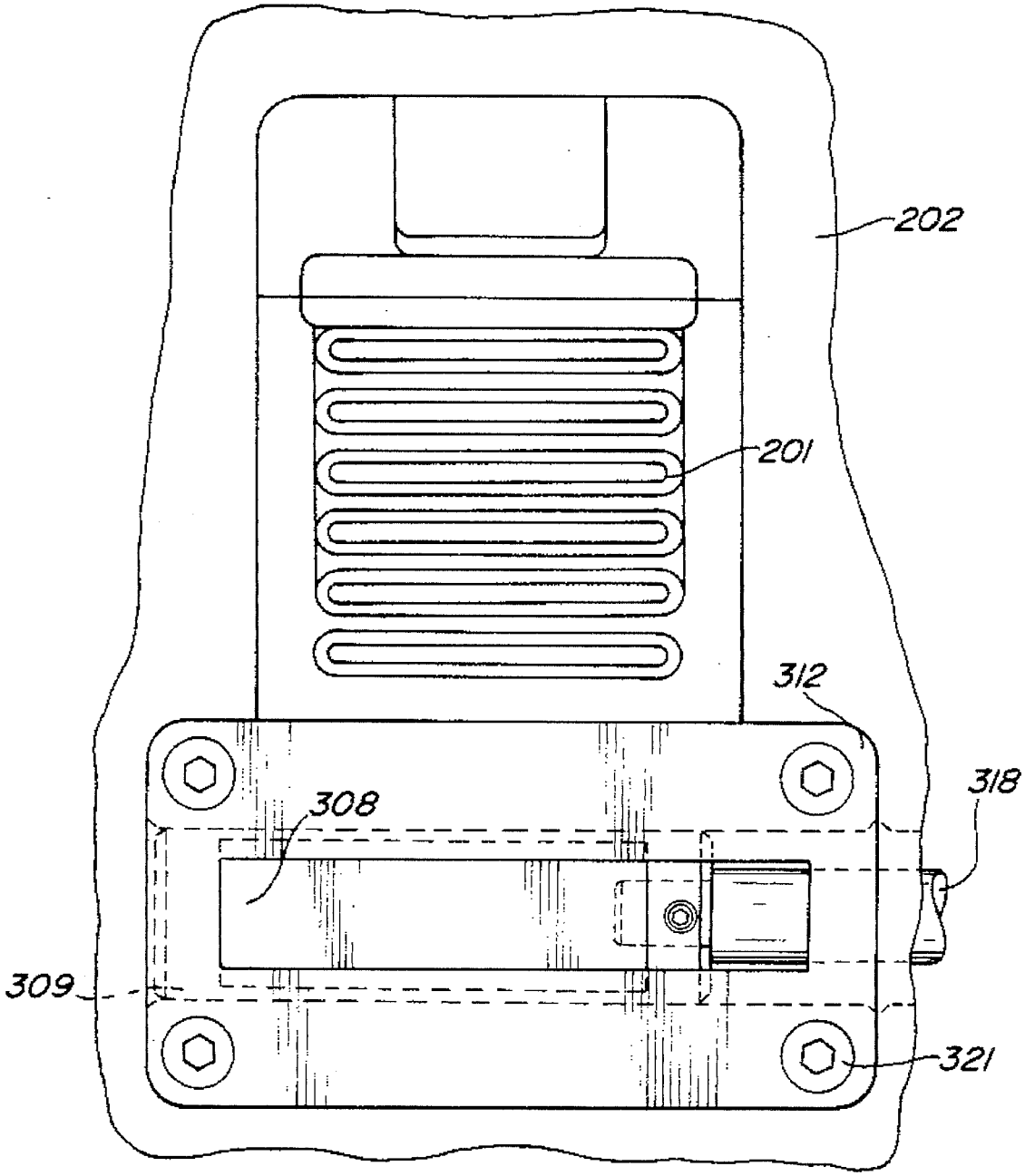
FIG. 7 is a plan view of the valve of FIG. 5 taken along a plane defined by the line 7—7 thereof.

FIGS. 5 through 7 illustrate an alternate embodiment of the present invention comprising a vacuum valve generally illustrated as 200.

The vacuum valve 200 includes a cover die 202 and an ejector die 204. The cover die 202 and the ejector die 204 function similarly to those previously discussed. However, in lieu of the rotatable slotless shut-off drum 28 provided in the ejector die 14 of the above-mentioned embodiment, the ejector die 204 includes a reciprocating shut-off bar 208, while the cover die 202 includes a reciprocable slotless bar 308 in lieu of a rotatable slotless drum 128.

With respect first to the lower die or the ejector die 204, the slotted bar 208 is fixedly positioned in a reciprocable carrier 209. The reciprocable carrier 209 is reciprocable within a channel 210 defined in the ejector die 204. A fluid passing slot 212 is defined in the upper part of the slotted bar 208. An access plate 211 is provided to allow access as required to the bar 208 or the carrier 209. The plate 211 is fastened to the die 204 by a plurality of fasteners 213.

The slotted bar 208 is movable between an open, fluid passing position (illustrated in FIGS. 5 and 6) and a closed, fluid blocking position. That the position of the slotted bar 208 in the illustration of FIGS. 5 and 6 is in its open position may be recognized by understanding that the fluid passageway connecting the cavity and the vacuum pump extends along the long axis of the valve, as illustrated above in FIG. 3, and the slot 212 is in alignment with the passageway. With respect to the positioning of the passageway itself, the construction of the vacuum valve 200 of the present embodiment is the same as that set forth above in association with FIGS. 2 through 4. Like the actuation of the rotatable shut-off drum 28, when the slot 212 of the slotted bar 208 is aligned with the fluid passageway 222, fluid may move freely between the cavity (not shown) and the pump (also not shown). However, when not in alignment, fluid flow is blocked. The lower half of a die cast vent block 201 is shown and functions in the same manner and is of the same construction as the vent block 20 described above with respect to FIGS. 2 through 4.

A driving assembly 214 is secured to the ejector die 204 by fasteners such as bolts 216. Like the driving assembly 78, the assembly 214 is preferably of the hydraulic type although pneumatic cylinders could as well be used. A connecting rod 218 connects the carrier 209 with a reciprocating driver such as a piston (not shown). As with the embodiment of FIGS. 2 through 4, the assembly 214 is coupled with one or more limit switches 224, 226, and 228 which, in turn, are coupled with a controller 230. The controller 230 along with the limit switches 224, 226, and 228 control the movement of the bar 208 in a manner similar to that described with respect to the valve 10 discussed above.

With respect next to the upper die or cover die 202, the cover die 202 and its components is substantially a mirror image of the ejector die 204. The slotless bar 308 is fixedly positioned in a reciprocable carrier 309. The reciprocable carrier 309 is reciprocable within a channel 310 defined in the cover die 202. An access plate 312 is provided to allow access to the bar 308 or to the carrier 309 as required for servicing. A plurality of fasteners 321 are provided to fasten the plate 312 to the die 202.

The slotless bar 308 is movable with the slotted bar 208 between an open, fluid passing position (illustrated in FIGS. 5 and 6) and a closed, fluid blocking position. The upper half of the vent block 201 is defined in the lower side of the cover die 202 for mating with the lower half of the vent block 201.

A driving assembly 314 is secured to the cover die 202 by fasteners such as bolts 316. Like the driving assemblies 78, 178, and 214, the assembly 314 is preferably of the hydraulic type although pneumatic cylinders could as well be used. A connecting rod 318 connects the carrier 309 with a reciprocating driver such as a piston (not shown). The assembly 314 is coupled with one or more limit switches 324, 326, and 328 which, in turn, are coupled with the controller 230. The controller 230 along with the limit switches 324, 326, and 328 control the movement of the slotless bar 308 so that it operates in concert with the slotted bar 208.

Figure 8:
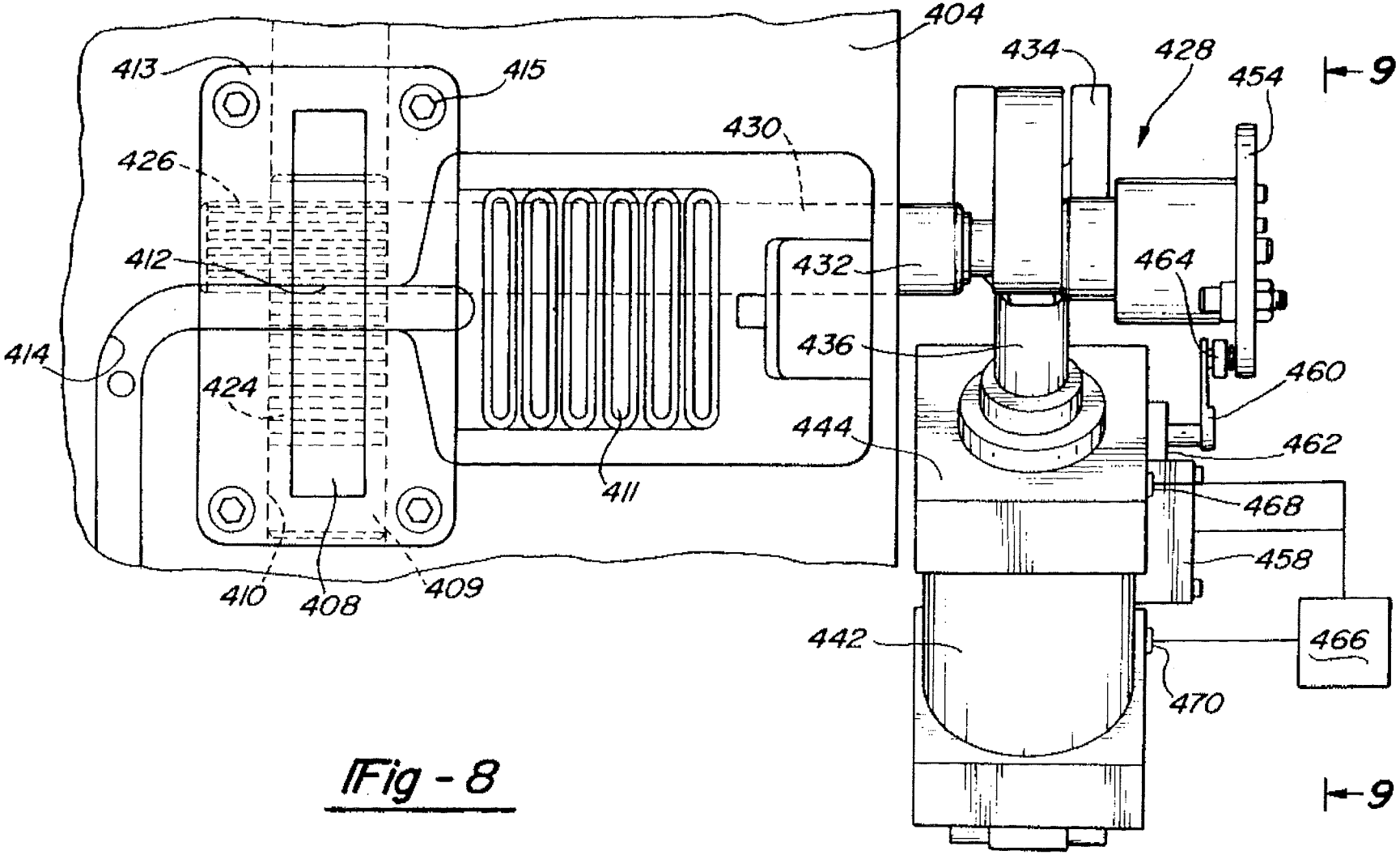
FIG. 8 illustrates a plan view of the ejector die of FIG. 5 with the view being similar to that of FIG. 7 but illustrating an optional drive mechanism.
Figure 9:
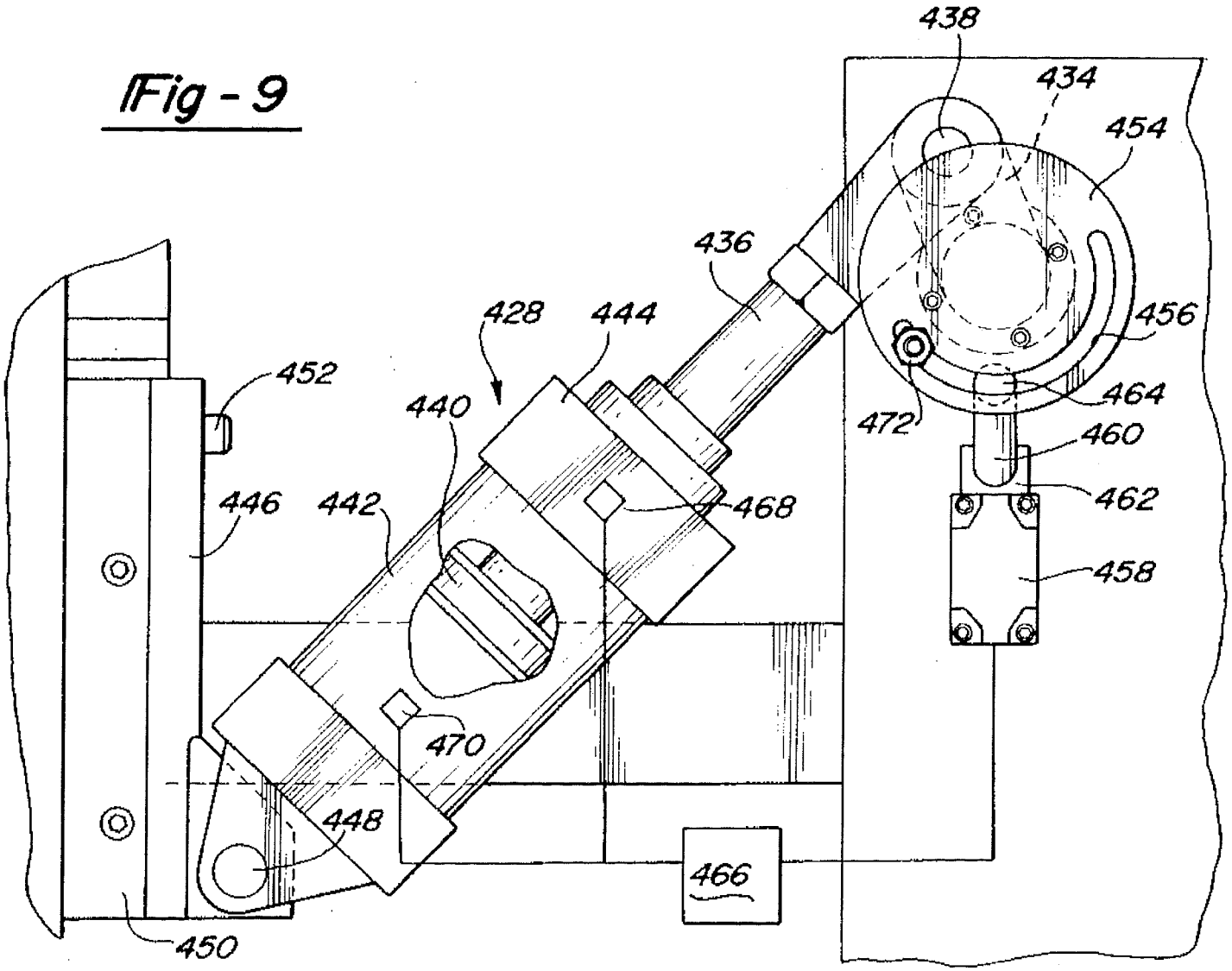
FIG. 9 is an illustration of an elevational side view of the embodiment of FIG. 8 taken along line 9—9 thereof.

FIGS. 8 and 9 illustrate an additional variation of the reciprocating bar embodiment of FIGS. 5 through 7. FIG. 8 illustrates a plan view of an ejector die 404 which includes a reciprocating slotted shut-off bar 408 similar in function and design to the bar slotted 208 discussed above with respect to FIGS. 5 and 6. Specifically, the slotted bar 408 is positioned in a reciprocable carrier 409 that reciprocates within a channel 410 defined in the ejector die 404. A fluid-passing slot 412 is defined in the upper part of the bar 408. A fluid passageway 414 is defined in the uppermost portion of the die 404. The elements of the cover die (not shown) that mates with the ejector die 404 are substantially identical, except that the reciprocating bar does not have a slot. A vent block 411 is also defined in the upper surface of the ejector die 404. An access plate 413 is removably provided on the upper surface of the ejector die 404 to provide service access to the carrier 409 and the bar 408. The access plate 413 is attached to the ejector die 404 by a plurality of fasteners 415.

The slotted bar 408 and its associated slotless bar (not shown) are movable between an open, fluid-passing position as illustrated in FIG. 8 when the slot 412 is in alignment with the passageway 414 and a closed, fluid-blocking position when out of alignment.

On the underside of the reciprocating bar 408 are defined a number of parallel grooves shown in shadow lines situated perpendicular to the long axis of the bar 408. The parallel grooves as a group define a rack 424. A pinion 426 has peripheral teeth that mesh with the grooves of the rack 424. Rotation of the pinion 426 clockwise effects axial movement of the bar 408 within the channel 410 of the die 404 such that the slot 412 is moved out of the illustrated alignment with the fluid passageway connecting the cavity (not shown) and the vacuum pump (not shown). Counterclockwise movement of the pinion 426 would act on the bar 408 in such a way that the bar 408 is moved back to its open, fluid-passing position.

A driving assembly, generally illustrated as 428, is provided to provide rotational power to the pinion 426 which is at a terminal end of a crankshaft 430. The crankshaft 430 is rotatably associated with the die 404 through a support sleeve 432. The sleeve 432 is integrally mated with the die 404. The crankshaft 430 includes an offset arm 434 to which is connected a terminal end of a connecting rod 436. The arm 434 and the connecting rod are pivotably mated by a pin 438. The opposite terminal end of the connecting rod 436 is fixed to a piston 440. The piston 440 is slidably fitted within a cylinder 442. The connecting rod 436 is positioned through an aperture defined in a cylinder endcap 444 that is fitted to the free end of the cylinder 442. The opposite end of the cylinder 442 comprises a pivoting end that is attached to a fixed plate 446 by a pin 448. The plate 446 is attached to an available fixed surface 450 which may or may not be the die apparatus itself. A plurality of fasteners 452 are used for fixing the plate 446 to the surface 450.

The pivoting relationship between the cylinder 442 and the plate 446 allows the cylinder 442 free pivoting movement through a limited range of motion required to accommodate the rotation of the crankshaft 430 as understood by those skilled in the art. As with the power sources of the other previously-discussed embodiments, the driving assembly 428 is preferably of the hydraulic type, although the system may be driven pneumatically.

Fixed to the end of the crankshaft 430 opposite the pinion 426 is a rotatable switch plate 454 having an arcuate slot 456. A limit switch 458 is mounted to a fixed surface and has a switch arm 460. One end of the arm 460 is a switch-connecting end 462 connected to the limit switch 458 and the other end of the arm 460 is a slot-contacting end 464 that rides in the arcuate slot 456. As the plate 454 is caused to rotate in a given direction in response to the rotational motion of the crankshaft 430, an end of the slot 456 contacts the slot-contacting end 464 of the arm 460, causing it to be slightly displaced. This displacement acts on the switch 458 so as to send a signal to a controller 466 which, in conjunction with signals issued from other limit switches 468 and 470, responds to the signals and effects changes in the cycle in a manner similar to those set forth above with respect to the previously-discussed embodiments. An adjustable travel stop 472 is optionally provided on the arcuate slot 456 to enable alteration of the length of the slot as required. Additional stops (none shown) may be added.

Figure 10:
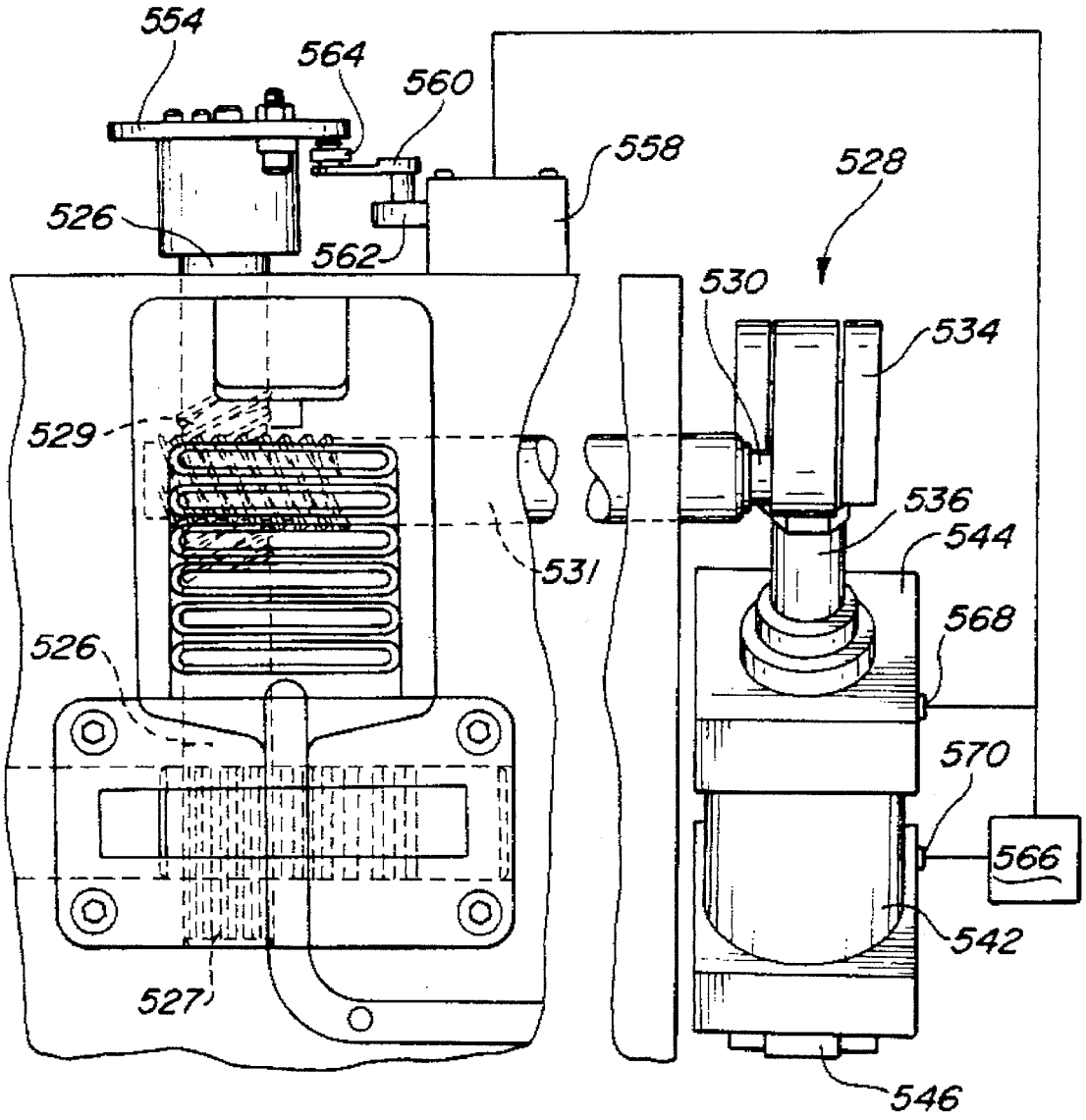
FIG. 10 illustrates a plan view of the ejector die of FIG. 5 with the view being similar to that of FIGS. 7 and 8 but illustrating yet another optional drive mechanism.

The final figure, FIG. 10, illustrates an alternate mechanism for driving a reciprocable bar. In this embodiment, and with the exception of the construction of the pinion as discussed hereafter, the ejector die is identical in configuration to that of ejector die 304 of FIGS. 8 and 9.

A combination pinion and worm gear shaft 526 is substituted herein for the pinion 426 of the embodiment of FIGS. 8 and 9. The shaft 526 includes a pinion gear end 527 and a worm gear section 529. Drivingly mated with the worm gear section 529 of the shaft 526 is a worm gear shaft 531 that is driven by a driving assembly, generally illustrated as 528, which is provided to give rotational power to the shaft 526 via the shaft 531. The shaft 531 is at a terminal end of a crankshaft 530. The crankshaft 530 includes an offset arm 534 to which is connected a terminal end of a connecting rod 536. The arm 534 and the connecting rod 536 are pivotably mated by a pin 538. The opposite terminal end of the connecting rod 536 is fixed to a piston (not shown) slidably fitted within a cylinder 542. The connecting rod 536 is positioned through an aperture defined in a cylinder endcap 544 that is fitted to the free end of the cylinder 542. The opposite end of the cylinder 542 comprises a pivoting end 546 that is attached to a fixed plate (not shown).

Fixed to the end of the shaft 526 opposite the pinion gear end 527 is a rotatable switch plate 554 having an arcuate slot (not shown). A limit switch 558 is mounted to the die and has a switch arm 560. One end of the arm 560 is a switch-connecting end 562 connected to the limit switch 558 and the other end of the arm 560 is a slot-contacting end 564 that rides in the arcuate slot. Operation of the limit switch is the same as described above with respect to FIGS. 8 and 9, with a signal being sent from the switch 558 to a controller 566 which, in conjunction with signals issued from other limit switches 568 and 570, responds to the signals and effects changes in the cycle in a manner similar to those set forth above with respect to the previously-discussed embodiments.

Attention must be given to the manufacture of the valve of the present invention so as to achieve the critical tolerances required for satisfactory operation. Perhaps most importantly the movable slotted member should be built with wire EDM machines to assure that the top of the member would be approximately 0.0002–0.0004 inches below the parting line when using only a single valve. The member would be approximately flush to minus 0.0001–0.0002 inches below the parting line when using a pair of symmetrically opposite valves. Where two valves are used, one would be located in the cover die half and the other in the ejector die half, and both movable slotted members would work in unison after the die cast die has closed, after vacuum pull, and prior to the fast shot stage.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A vacuum valve adapted for use with a die pair in which the die pair has a cavity generally in both dies and is separated by a parting line or plane and a vacuum pump, said vacuum valve comprising:

an ejector die portion including a fluid passageway adapted for enabling flow of fluid from said cavity within the die pair to said vacuum pump, said ejector die portion further including a movable slotted valve member movable between a fluid-passing position to a fluid-blocking position, said movable slotted valve member having a slotted end including an end face and a slot in said end face and an actuation end;

a cover die portion adapted to be coupled with said ejector die portion, said ejector die portion and said cover die portion being separated by a parting line or plane that is coplanar with said parting line or plane of said die pair and said cover die portion including an abutment surface;

said fluid passageway being positioned adjacent said parting line or plane of said ejector die portion and said cover die portion and said slot in alignment with said fluid passageway in an open position; and control means for controlling movement of said movable slotted valve member;

whereby said end face and slot of said movable slotted valve member contacts said abutment surface of said cover die portion such that molten material entering said passageway from said cavity is prevented from further flow by movement of said movable slotted valve member to a closed position blocking said passageway along the parting line or plane and to insure substantially full gas evacuation of said die cavity when in said open position.

2. The vacuum valve according to claim 1 in which said slotted end of said slotted valve member has an abutment surface and said cover die portion further includes an opposed slotless member, said opposed slotless member having an abutment surface, said abutment surface of said slotless member abutting said abutment surface of said slotted valve member, said slotless member being adapted to move with said slotted member between said fluid-passing position and said fluid-blocking position.

3. The vacuum valve according to claim 1 wherein said movable slotted valve member includes a rotatable cylinder having a fluid passage end defining said slotted end and means for rotating said cylinder.

4. The vacuum valve according to claim 3 wherein said cylinder has a periphery, said periphery having a plurality of spaced apart and parallel teeth defined therein, and said means for rotating said cylinder comprises a reciprocating toothed bar meshingly engaged with said teeth of said cylinder.

5. The vacuum valve according to claim 1 wherein said movable slotted valve member includes a reciprocating bar having a fluid passage end defining said slotted end and means for reciprocating said bar.

6. The vacuum valve according to claim 5 wherein slotted end includes a slot and wherein said bar has a long axis, said slot being defined on said bar transversely with respect to said long axis.

7. The vacuum valve according to claim 6 wherein said bar includes a side, said side having a plurality of spaced apart and parallel teeth defined therein, and said means for reciprocating said bar comprises a toothed machine part.

8. The vacuum valve according to claim 7 wherein said toothed machine part comprises a pinion.

9. The vacuum valve according to claim 6 wherein said means for reciprocating said bar comprises a hydraulic cylinder having a piston member and a shaft connecting said bar and said piston member.

10. A die casting apparatus adapted to receive molten material from a material source and further adapted for attachment to a vacuum pump, said apparatus comprising:

a first die block;

a second die block adapted to be coupled with said first die block;

said die blocks being separated by a parting line or plane;

an article-forming cavity defined between said first and second die blocks;

a molten material-passing passageway connecting said cavity with said material source;

a fluid-passing passageway connecting said cavity with said vacuum pump;

a vacuum valve disposed along said fluid-passing passageway, said vacuum valve including a movable valve member movable from a fluid-passing open position to a fluid-blocking closed position, said valve having an upper end face including a fluid-passing slot in said upper end face.

11. The die casting apparatus of claim 10 wherein said vacuum valve further includes a movable slotless member abutted against said movable valve member for movement therewith between said open and closed positions.

12. The die casting apparatus of claim 10 wherein said movable valve member comprises a rotatable drum.

13. The die casting apparatus of claim 12 wherein said rotatable drum further includes a periphery, said periphery having defined therein a plurality of gear teeth.

14. The die casting apparatus of claim 13 wherein said movable valve member includes an elongated rack being axially movable, said rack having a rotatable drum-engaging side, said side having defined therein a plurality of gear teeth, said gear teeth of said rack being meshingly engaged with said gear teeth of said drum.

15. The die casting apparatus of claim 12 wherein said movable valve member comprises an axially movable bar meshing with said drum and having an upper side, said slot being defined in said upper side.

16. The die casting apparatus of claim 15 wherein said movable bar further includes a gear-engaging side, said gear engaging side having defined therein a plurality of gear teeth.

17. The die casting apparatus of claim 16 wherein said movable valve member includes a pinion having a plurality of gear teeth, said gear teeth of said bar being meshingly engaged with said gear teeth of said pinion.

18. The die casting apparatus of claim 15 wherein said movable valve member includes a hydraulic cylinder, a piston movable within said cylinder, and a rod interconnecting said bar and said piston.

19. A vacuum valve for controlling the flow of fluid between a die casting cavity defined between a pair of dies and a vacuum pump, said valve comprising:

a fluid entry passage having a first end and a second end, said first end being fluidly attached to said cavity;

a fluid exit passage having a first end and a second end, said second end being fluidly attached to said vacuum pump;

a movable valve member, said valve member having an end face including a slot, said slot being positionable by movement of said member between an open, fluid-passing position wherein said slot allows movement of a fluid between said second end of said fluid entry passage and said first end of said fluid exit passage and a closed, fluid-blocking position wherein fluid is not allowed to bypass said movable valve member; and means for moving said movable valve member between said open and closed positions.

20. The vacuum valve of claim 19 wherein said movable valve member comprises a rotatable drum having an upper end, said slot being defined in said upper end of said drum.

21. The vacuum valve of claim 20 wherein said rotatable drum further includes a periphery, said periphery having defined therein a plurality of gear teeth.

22. The vacuum valve of claim 21 wherein said means for moving comprises an elongated rack, said elongated rack being axially movable, said rack having a rotatable drum-engaging side, said side having defined therein a plurality of gear teeth, said gear teeth of said rack being meshingly engaged with said gear teeth of said drum.

23. The vacuum valve of claim 19 wherein said movable valve member comprises an axially movable bar having an upper side, said slot being defined in said upper side.

24. The vacuum valve of claim 23 wherein said movable bar further includes a gear-engaging side, said gear engaging side having defined therein a plurality of gear teeth.

25. The vacuum valve of claim 24 wherein said means for moving comprises a pinion having plurality of gear teeth, said gear teeth of said bar being meshingly engaged with said gear teeth of said pinion.

26. The vacuum valve of claim 23 wherein said means for moving comprises a hydraulic cylinder, a piston movable within said cylinder, and a rod interconnecting said bar and said piston.

* * * * *